US008800634B2

(12) United States Patent
Gramsch

(10) Patent No.: US 8,800,634 B2
(45) Date of Patent: Aug. 12, 2014

(54) DEVICE FOR FASTENING A WINDOW BLIND

(71) Applicant: Hunter Douglas Industries Switzerland GmbH, Lucerne (CH)

(72) Inventor: Wilfried Gramsch, Beverstedt (DE)

(73) Assignee: Hunter Douglas Industries Switzerland GmbH, Lucerne (CH)

( * ) Notice: Subject to any disclaimer, the term of this patent is extended or adjusted under 35 U.S.C. 154(b) by 20 days.

(21) Appl. No.: 13/676,484

(22) Filed: Nov. 14, 2012

(65) Prior Publication Data

US 2014/0130991 A1 May 15, 2014

(51) Int. Cl.
*E06B 9/50* (2006.01)

(52) U.S. Cl.
USPC ..... 160/323.1; 160/903

(58) Field of Classification Search
USPC ..... 160/323.1, 903, 324, 325, 326; 248/268, 269, 270, 271, 272
IPC ..... E06B 9/50
See application file for complete search history.

(56) References Cited

U.S. PATENT DOCUMENTS

| | | | | | |
|---|---|---|---|---|---|
| 729,881 | A * | 6/1903 | Mathis | 248/268 |
| 759,462 | A * | 5/1904 | Morris | 248/267 |
| 2,487,648 | A * | 11/1949 | Green | 248/267 |
| 4,270,720 | A * | 6/1981 | Fukuchi | 248/269 |
| 4,399,857 | A * | 8/1983 | Honma | 160/323.1 |
| 4,729,418 | A * | 3/1988 | Rude | 160/323.1 |
| 5,450,891 | A * | 9/1995 | Benthin | 160/323.1 |
| 6,457,688 | B1 * | 10/2002 | Welfonder | 248/266 |
| 7,267,311 | B2 * | 9/2007 | Jung | 248/266 |
| 7,370,686 | B2 * | 5/2008 | Rasmussen | 160/323.1 |
| 2005/0224196 | A1 | 10/2005 | Rasmussen | |

* cited by examiner

*Primary Examiner* — David Purol

(57) ABSTRACT

A device (10) for fastening a window blind with a window blind end piece (12), which has a front surface (13), on which is arranged an axis segment (15). The axis segment (15) interacts with a mounting element (18), which can be rotated about an axis of rotation (44) of the axis segment (15), for opening and/or closing a holding mount (17). An axial guide (47) is provided, which fixes an axial position of the mounting element (18) in relation to the axis of rotation (44) of the mounting element (18) about the axis segment (15). In order to reduce the risk of premature wear and to simplify a change between left-sided or right-sided mounting, the device (10) has a positioning device (48), which is separate from the axial guide (47). The positioning device (48) is provided for the detachable fixing of the mounting element (18) in at least one rotation position of the mounting element (18) in relation to the axis segment (15).

19 Claims, 8 Drawing Sheets

DEVICE FOR FASTENING A WINDOW BLIND

FIELD OF THE INVENTION

The present invention pertains to a device for fastening a window blind with a window blind end piece, which has a front surface, on which is arranged an axis segment, whereby the axis segment interacts with a mounting element, which can be rotated about an axis of rotation of the axis segment, for opening and/or closing a holding mount, and an axial guide is provided, which fixes an axial position of the mounting element in relation to the axis of rotation of the mounting element about the axis segment.

BACKGROUND OF THE INVENTION

Such a device is known from the document US 2005/0224196 A1, the entire contents of which are herewith part of this application because of the reference. In this case, an axial guide is used, which comprises a groove embedded into the essentially cylindrical circumferential surface of the axis segment. For producing the axial guide, a tongue, which is associated with the mounting element, meshes with the groove, as a result of which the position of the mounting element is fixed in the axial direction to the axis segment. Here, the tongue is designed as being shorter than the associated groove.

In practice, the tongue is used not only for producing the axial guide, but at the same time also for locking the mounting element in preset rotation positions in relation to the axis segment. For this, locking recesses are provided in the end areas of the groove for locking the tongue.

The drawback here is that the tongue, which is designed as comparatively short, can be sheared off relatively easily. Consequently, a reliable operability cannot be guaranteed. In addition, two grooves deviating from each other in their arrangement must be inserted into the axis segment for preparing a selective left-sided or right-sided mounting of the device or of the window blind end piece. The tongue is attached to the mounting element, such that the mounting element is suitable for a left-sided mounting in a first position in relation to the axis segment. For a right-sided mounting, the mounting element must be brought into a second position different from the first position in relation to the axis segment and mounted. The drawback here is that, for example, in the case of an at first incorrect mounting of the mounting element at the axis segment, the mounting element must first be removed, rotated and then mounted again in the correct position for the desired mounting. There is consequently the risk of a premature wear and/or shearing off of the tongue, as a result of which the operability of the device is compromised.

SUMMARY OF THE INVENTION

Therefore, the basic object of the present invention is to perfect a device of the type mentioned in the introduction, such that the risk of a premature wear is reduced and a change between a left-sided or right-sided mounting is simplified.

The basic object of the present invention is accomplished by a device of the type mentioned in the introduction, which provides a positioning means, which is separate from the axial guide, for the detachable fixing of the mounting element in at least one rotation position of the mounting element in relation to the axis segment.

It is advantageous here that separate elements, which are separated from one another, are provided, on the one hand, for producing axial guiding or axial securing of the mounting element in relation to the axis segment and, on the other hand, for the detachable fixing of the position of the mounting element in relation to a rotation about the axis of rotation of the axis segment.

Thus, the axial guide is designed exclusively for forming the axial position fixing in the longitudinal direction to the axis of rotation of the axis segment and for preparing a guide for a rotation of the mounting element about the axis of rotation of the axis segment. This makes possible the production of a stable and low-wear axial guide, such that the risk of a premature wear is reduced. The axial guide is especially designed, such that it makes possible a rotation of the mounting element with a rotation of at least 360° about the axis segment. Consequently, the mounting element can be freely selectively adjusted for a left-sided or right-sided mounting of the device and/or the window blind end piece in case of a mounting at the axis segment already carried out. The device according to the present invention is preferably used as a rotatable counterbearing at one end of a window blind, whereby an actuating means with holding function, especially a spring mechanism, a chain drive and/or a motor with a brake function, can be associated with the end of the window blind turned away from the counterbearing or the device according to the present invention.

The positioning means is exclusively designed for detachably fixing the position of the mounting element with regard to the rotation position. Consequently, a low-wear positioning means can be achieved, which makes possible a reliable fixing in a rotation position even after repeated actuation of the mounting element. Several rotation positions are especially feasible for the detachable fixing of the position of the mounting element in relation to a rotation of the mounting element about the axis of rotation of the axis segment or of the mounting element.

According to another embodiment, the axial guide is designed as a slideway guide, which comprises a groove and a bar meshing with the groove. Such an axial guide, which makes possible a rotation of the mounting element about the axis segment, can be produced in a cost-effective manner. The axis segment preferably has a groove running concentric to the axis of rotation of the axis segment in a circumferential surface that especially has a cylindrical segment shape. The groove especially makes possible at least one 360° rotation of the mounting element about the axis segment, whereby preferably the axis segment forms the axis of rotation. The mounting element may have a bar on an inner side that especially has a cylindrical segment shape. Here, the bar preferably runs or extends along the entire inner side. The bar of the mounting element is especially at least as long as the groove of the axis segment. A reliable and low-wear axial guide is consequently produced.

According to a variant, the positioning means comprises a locking block, which is arranged on a circumferential surface of the axis segment that especially has a cylindrical segment shape and/or at least a partially circular shape. At least one rotation position of the mounting element can be fixed by means of a locking block. The locking block is preferably designed as a raised section extending in the outwards direction in relation to the circumferential surface of the axis segment. Such a raised section can be produced in a simple and cost-effective manner. The locking block may be arranged on a side of the axis segment turned away from the holding mount.

The locking block especially has two stop faces arranged turned away from one another. The stop faces are preferably aligned parallel to a central axis of the window blind end piece with regard to their longitudinal alignment. An opening angle greater than 90°, especially between 95° and 165°, especially preferably between 120° and 150°, arises especially between the circumferential surface of the axis segment and the stop faces. The stop faces may each be arranged transversely, especially at right angles, to the direction of rotation of the mounting element about the axis segment. Such stop faces with corresponding elements of the mounting element make possible a simple fixing of the mounting element in a rotation position. Because of the obtuse angle existing between the circumferential surface of the axis segment and the respective stop face, an overwinding of the mounting element by hand beyond a preset rotation position is simplified.

Furthermore, the locking block may have two locking grooves, whereby preferably the locking grooves are each aligned parallel to a central axis of the window blind end piece with regard to their longitudinal alignment. The locking grooves are each especially arranged transversely, especially at right angles, to the direction of rotation of the mounting element about the axis segment. Such locking grooves along with the elements of the mounting element corresponding to the locking grooves make possible the fixing of the mounting element in one or more rotation positions. The locking grooves preferably have an arched locking surface, as a result of which an overwinding of the mounting element by hand beyond a preset rotation position is simplified.

According to another embodiment, the positioning means has a first locking element, which is arranged on an inner side of the mounting element that especially has a cylindrical segment shape. Here, the first locking element is especially designed as an element corresponding to the stop faces and/or to the locking grooves. The locking bar especially interacts with a stop face and/or a locking groove of the locking block preferably for detachably fixing the mounting element in at least one rotation position. The first locking element is preferably designed as a locking bar. The locking bar may be aligned, with regard to its longitudinal alignment, parallel to a central axis of the window blind end piece. The locking bar is especially arranged transversely, especially at right angles, to the direction of rotation of the mounting element about the axis segment. The locking bar is preferably designed as an element corresponding to the locking grooves, especially in order to achieve two rotation positions.

According to another variant, the mounting element has an axial mounting for mounting the axis segment, whereby the axial mounting and/or the mounting element have an opening in their circumference. The opening may be provided for inserting a holding segment, and one especially corresponding to the holding mount. The mounting element preferably has an essentially C-shaped basic shape in cross section. A C-shaped basic shape makes possible a compact and yet functional shape of the mounting element. The locking bar is especially arranged facing the opening of the C-shaped mounting element. Accordingly, the locking bar may be positioned centrally on the inner side of the mounting element.

Preferably, the positioning means has a second locking element and/or a third locking element. As a result of this, three rotation positions deviating from each other are feasible. Here, the second and/or third locking element may be designed as an element corresponding to the stop faces and/or to the locking grooves. The second locking element and/or third locking element are especially designed as a front face each. The front faces are preferably designed as front faces, facing one another, and especially at an end, which define the opening in the circumference of the axial mounting and/or of the mounting element. The two front faces are preferably designed as an element corresponding to a stop face each so as to especially achieve a rotation position. The front faces are especially aligned, with regard to their longitudinal alignment, parallel to a central axis of the window blind end piece. The front faces are preferably arranged transversely, and especially at right angles, to the direction of rotation of the mounting element about the axis segment.

According to another embodiment, the locking block has a material thickness which makes possible a jumping of the first, second and/or third locking element over the locking block with a sufficient expenditure of force in the direction of rotation of the mounting element about the axis segment. An essentially free rotation of the mounting element about the axis segment is made possible as a result of this. The mounting element can especially be rotated into any desired rotation position in a state mounted in the axial guide. Consequently, the mounting element, in the state mounted at the axis segment by means of the axial guide, can be freely selectively rotated into a position for right-sided or left-sided mounting of the device and/or of the window blind end piece at a fastening element. A jumping over of the locking block with the first, second and/or third locking element can preferably be achieved based on a manual, and especially single-handed, actuation. Thus, the actuation and/or adjustment of the position of the mounting element can be achieved without tools.

A process for using a device according to the present invention for fastening a window blind and/or window blind end piece is especially advantageous, whereby a mounting element fastened to the axis segment by means of the axial guide can be selectively used for right-sided or left-sided mounting, especially for mounting a holding segment in the holding mount, because of a rotation of the mounting element about the axis segment. Because of the structurally separate production of the axial guide and the positioning means, a wear-resistant and simple-to-operate device is produced here.

The present invention is explained in detail below on the basis of the figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
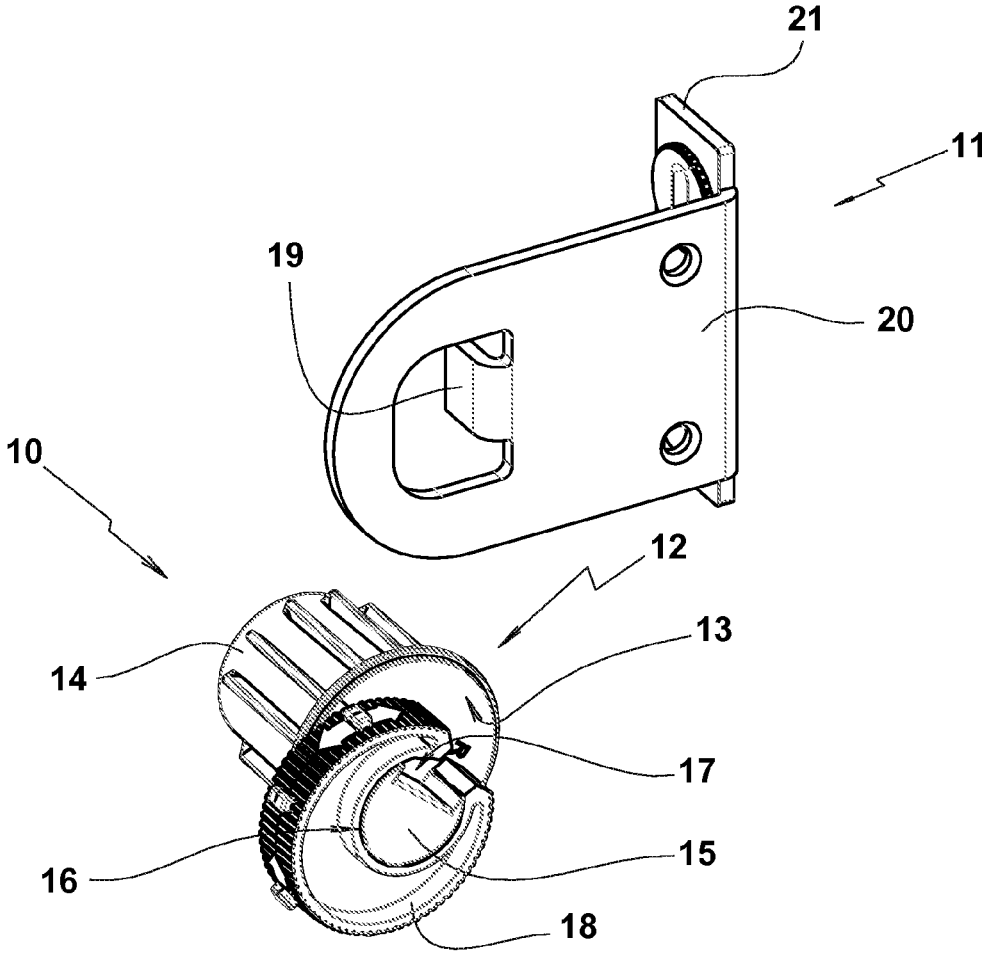
FIG. 1 is a perspective view of a device according to the present invention before a right-sided mounting at a fastening element.

Referring to the drawings in particular, FIG. 1 shows a perspective view of a device 10 according to the present invention before a right-sided mounting at a fastening element 11. Device 10 has a window blind end piece 12. The window blind end piece 12 is provided to be fastened to a free end of a window blind tube or window blind rod (not shown in detail here). This end can be fastened to a fastening element 11 by means of a window blind end piece 12 at a free end of the window blind tube or of the window blind rod. An actuation means with holding function, especially a spring mechanism, a chain drive and/or a motor with a brake function can be arranged at the end turned away from the end of the window blind tube or window blind rod.

The window blind end piece 12 has a front surface 13, whereby the front surface 13 has a circular or disk-like shape. The front surface 13 faces the fastening element 11 for mounting at or in the state mounted at fastening element 11. In the exemplary embodiment shown here, a window blind casing 14 is associated with the window blind end piece 12 on a side turned away from the front surface 13. The window blind casing 14 is rotatably mounted about a central axis of the window blind end piece 12. Furthermore, the window blind casing 14 is nonrotatably connected to the window blind tube or window blind rod.

An axis segment 15 is arranged on the front surface 13 of the window blind end piece 12. In this exemplary embodiment, the axis segment 15 is designed in one piece with the front surface 13 and the window blind end piece 12. The axis segment 15 has an essentially cylindrical design and has a circumferential surface 16. In a top view of the axis segment 15, the circumferential surface 16 has an area with a cylindrical segment-shaped or annular segment-shaped design or a circular section. The maximum diameter of the axis segment 15 is less than the diameter of the front surface 13. In this exemplary embodiment, the diameter of the front surface 13 is twice as great as the maximum diameter of the axis segment 15.

The circumferential surface 16 of the axis segment 15, which has an essentially cylindrical segment shape, is interrupted by a holding mount 17. The holding mount 17 is provided for accommodating a holding segment 19 of the fastening element 11. In this exemplary embodiment, holding segment 19 is designed as a bar 19, which extends at right angles to a first leg 20 of the fastening element 11. The fastening element 11 has a second leg 21, which extends at right angles to the first leg 20 and parallel to the holding segment 19. In this case, the second leg 21 is used for fastening the fastening element 11 to a wall or ceiling, which is not shown in detail here. A window blind end piece 12 can be fastened to the first leg 20.

A separate mounting element 18 is associated with the axis segment 15 for mounting the window blind end piece 12 at the fastening element 11. The mounting element 18 can be rotated about the axis segment 15 and can be detachably fixed or locked in preset rotation positions.

Figure 2:
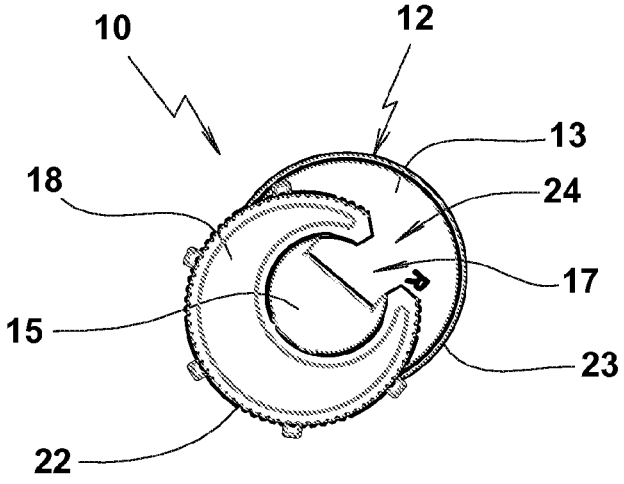
FIG. 2 is a front view of the device according to the present invention according to FIG. 1 without fastening element.

FIG. 2 shows a front view of the device 10 according to the present invention according to FIG. 1 without fastening element 11. In this exemplary embodiment, mounting element 18 is located in a first rotation position. In this first rotation position, the mounting element 18 is locked in position opposite the axis segment 15, such that the holding mount 17 is ready for a right-sided mounting and insertion of the holding segment 19. In addition, in this exemplary embodiment, at least a part of an outer circumference 22 of the mounting element 18 in the first rotation position protrudes over an outer circumference 23 of the front surface 13.

The mounting element 18 has a C-shaped basic shape with an opening 24 in the circumference of the mounting element 18. In the first rotation position, the mounting element 18 or opening 24 is arranged, such that the holding mount 17 is accessible for inserting the holding segment 19.

Figure 3:
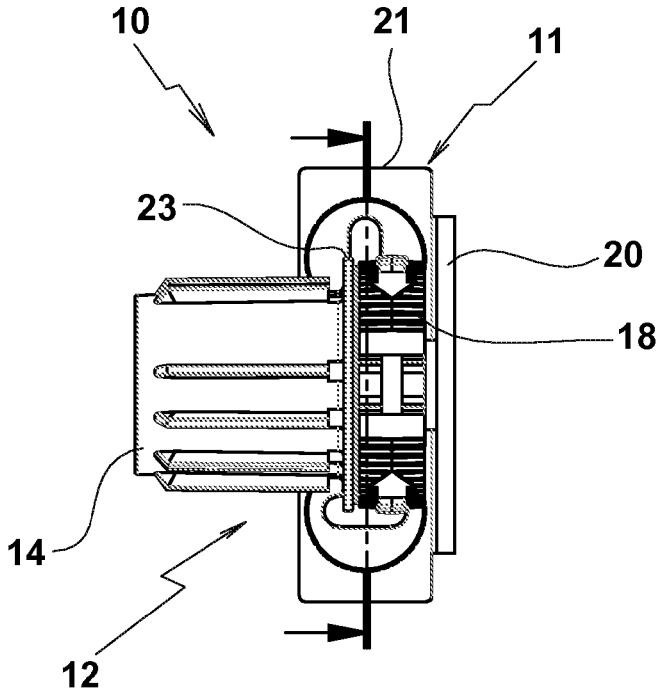
FIG. 3 is a lateral view of the device according to the present invention according to FIG. 1 in a state mounted at the fastening element.

FIG. 3 shows a lateral view of device 10 according to the present invention according to FIG. 1 in a state mounted at the fastening element 11. In this case, the mounting element 18 is located in a second rotation position. In this exemplary embodiment, in this second rotation position, the mounting element 18 is locked in position opposite the axis segment 15, such that the position of the outer circumferences 22, 23 of the mounting element 18 and of the front surface 13 correspond to one another or lie on top of one another.

The mounting element 18 has a width that corresponds to the height of the axis segment 15 starting from the front surface 13. Thus, the sides of the axis segment 15 and of the mounting element that are turned away from the front surface 13 are at least partly or extensively in contact with an inner surface of the first leg 20 of the fastening element 11.

Figure 4:
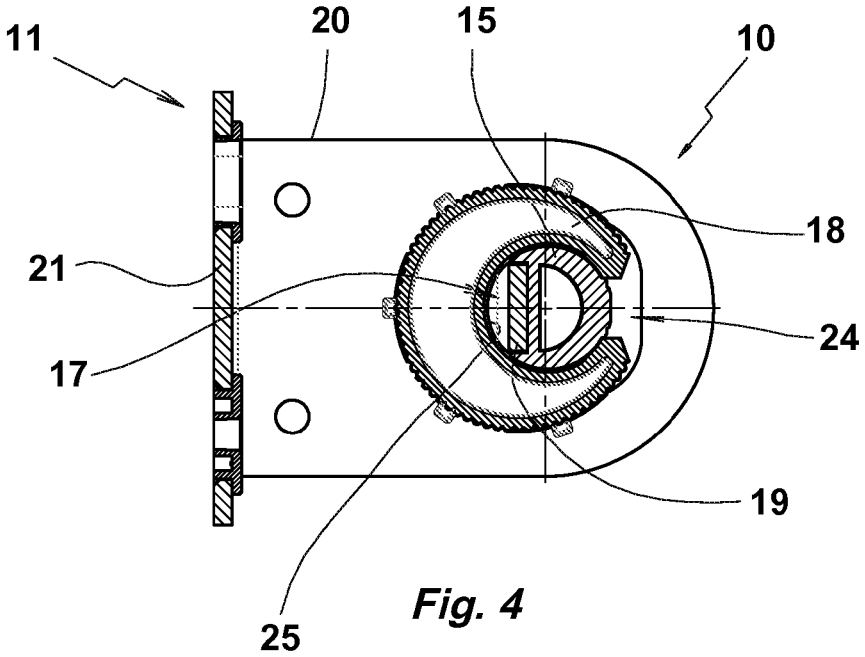
FIG. 4 is a sectional view of the device according to the present invention according to FIG. 3.

FIG. 4 shows a lateral view of device 10 according to the present invention according to FIG. 3. In the second rotation position of the mounting element 18 shown, the opening 24 of the mounting element 18 is arranged on the side of the axis segment 15 turned away from the holding mount 17. In this case, the holding mount 17 for accommodating the holding segment 19 is defined by an inner side 25 of the mounting element 18. The holding segment 19 is thus held securely transversely to the axial direction of the window blind end piece 12 or of the axis segment 15. A secure hold in the longitudinal direction to the axial direction of the window blind end piece 12 is guaranteed by the inner side of the first leg 20 of the fastening element 11.

Figure 5:
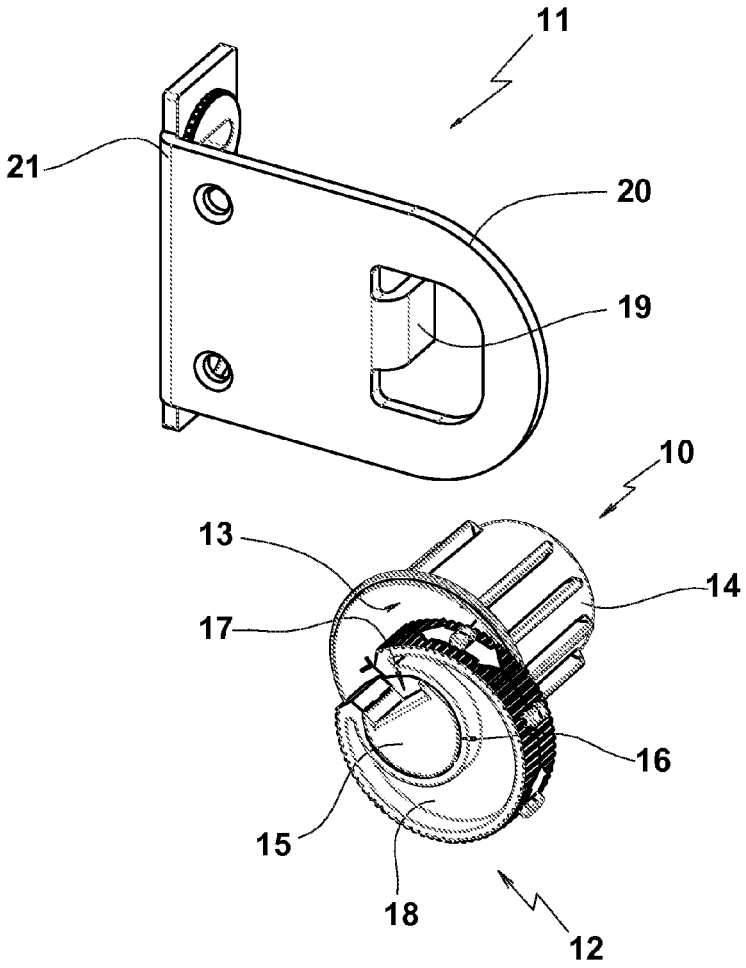
FIG. 5 is a perspective view of the device according to the present invention before a left-sided mounting at a fastening element.

FIG. 5 shows a perspective view of the device 10 according to the present invention before a left-sided mounting at a fastening element 11. In this exemplary embodiment, the mounting element 18 is located in a third rotation position. In this third rotation position, the mounting element 18 is locked in position opposite the axis segment 15, such that the holding mount 17 is ready for a left-sided mounting and insertion of the holding segment 19.

Figure 6:
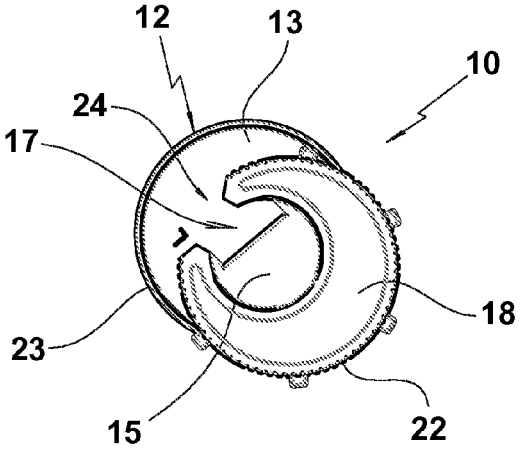
FIG. 6 is a front view of the device according to the present invention according to FIG. 5 without fastening element.

FIG. 6 shows a front view of the device 10 according to the present invention according to FIG. 5 without fastening element. In comparison to the first rotation position, a mirror-symmetrical arrangement of the mounting element 18 to the front surface 13 is produced compared to the front view according to FIG. 2.

Figure 7:
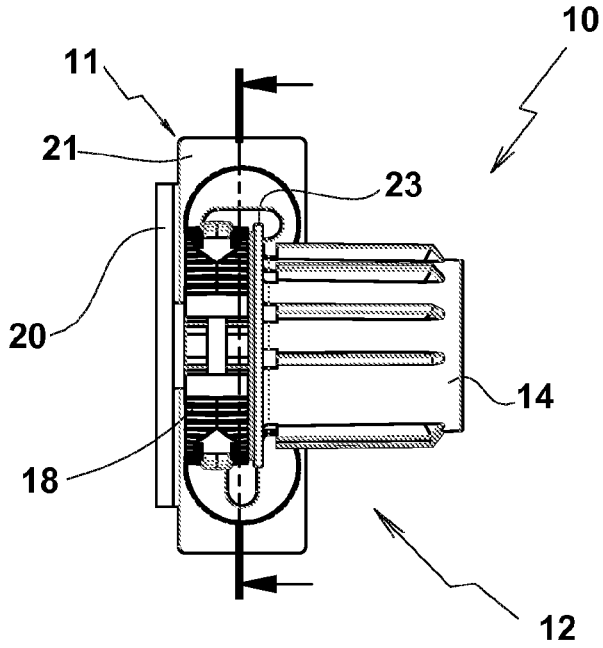
FIG. 7 is a lateral view of the device according to the present invention according to FIG. 5 in a state mounted at the fastening element.
Figure 8:
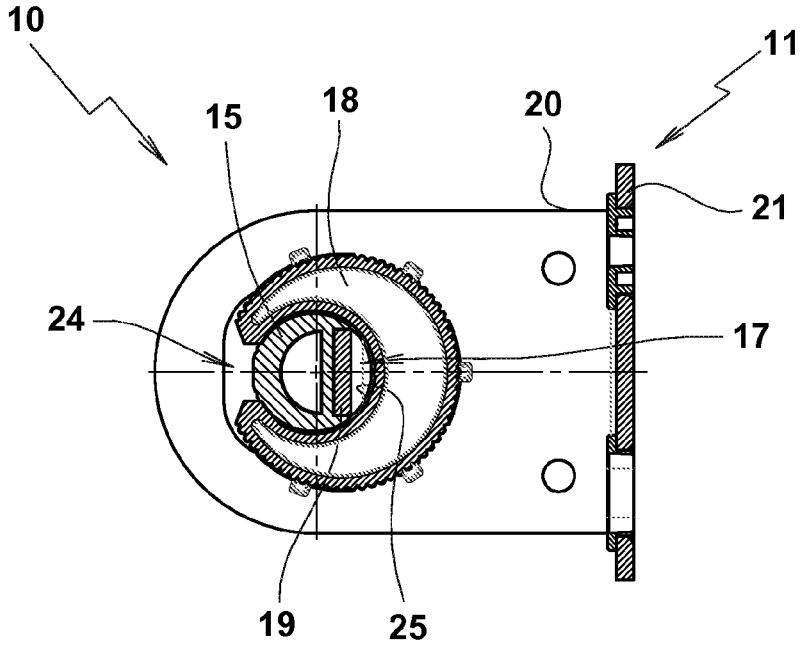
FIG. 8 is a sectional view of the device according to the present invention according to FIG. 7.

FIG. 7 shows a lateral view of device 10 according to the present invention according to FIG. 5 in a state mounted at the fastening element 11, whereby FIG. 8 shows a sectional view of device 10 according to the present invention according to FIG. 7. In this case, the mounting element 18 is located in the second rotation position. Similar to FIGS. 3 and 4, in the second rotation position of the mounting element 18, the opening 24 of the mounting element 18 is arranged on the side of the axis segment 15 turned away from the holding mount 17.

Thus, a total of three rotation positions are provided for mounting element 18, in which the position of mounting element 18 can be detachably fixed, and can especially be locked in, opposite the axis segment 15. By means of a rotation of the mounting element 18 about an axis of rotation of the axis segment 15, the mounting element 18 can be freely selectively rotated between and from the first, second or third rotation position to the first, second or third rotation position. The window blind end piece 12 with mounted mounting element 18 can be used in a simple manner either for a left-sided or a right-sided mounting because of the rotatability and free selectability of the rotation position.

Figure 9:
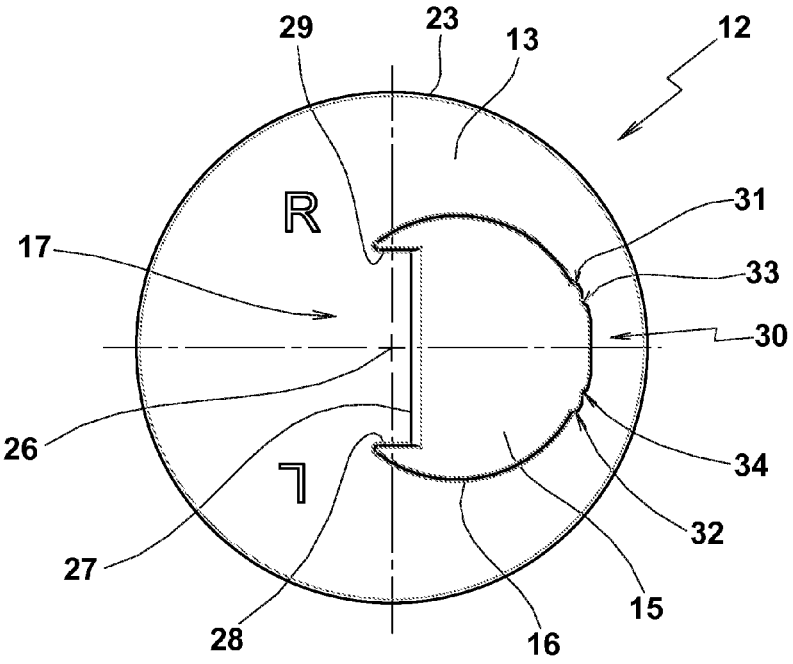
FIG. 9 is a front view of the window blind end piece for the device according to the present invention.

FIG. 9 shows a front view of the window blind end piece 12 for device 10 according to the present invention. The axis segment 15 is positioned eccentric to a central axis 26 of the window blind end piece 12 on the front surface 13. The holding mount 17 is arranged on a side of the axis segment 15 facing the central axis 26. In this case, holding mount 17 is designed as a groove-like or U-shaped recess in the circumferential surface 16 of the essentially cylindrical axis segment 15. The holding mount 17 has a flat mount base 27 and two side walls 28, 29 turned away from one another. The side walls 28, 29 extend at right angles to the mount base 27 and thus limit the length of the mount base 27.

A locking block (Locking contour) 30 is arranged on the circumferential surface 16 on a side of the axis segment 15 turned away from the holding mount 17. The locking block 30 projects above the circumferential surface 16. In this exemplary embodiment, the locking block protrudes outwards at most approximately 0.5 mm above the circumferential surface 16.

The locking block 30 has two stop faces 31, 32 turned away from one another. The stop faces 31, 32 define the maximum expansion of the locking block 30 in the circumferential direction of the axis segment 15. In this case, the stop faces 31, 32 are aligned parallel to the central axis 26. Moreover, the stop faces 31, 32 have an inclination opposite a normal line to the circumferential surface 16, such that an obtuse opening angle greater than 90° arises between the circumferential surface 16 and the stop faces 31 or 32.

Furthermore, the locking block 30 has two locking grooves 33, 34, which are each aligned parallel to the central axis 26 and at right angles to the direction of rotation of the mounting element 18 about the axis segment 15.

Figure 10:
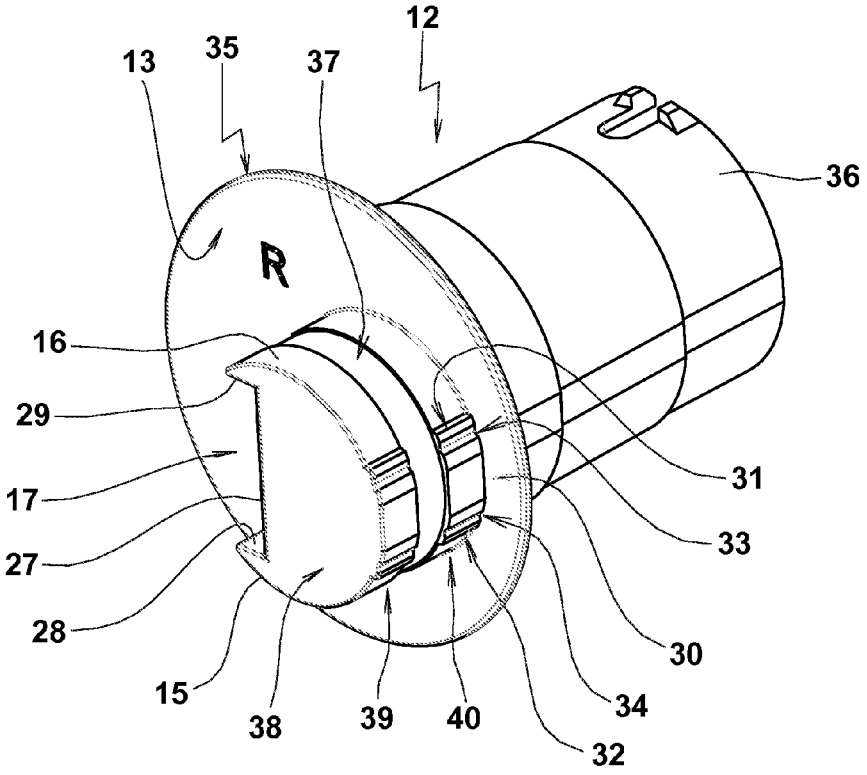
FIG. 10 is a perspective view of the window blind end piece according to FIG. 9.

FIG. 10 shows a perspective view of the window blind end piece 12 according to FIG. 9. The window blind end piece 12 comprises a disk 35 with the front surface 13, on which axis segment 15 is arranged. An essentially tubular projection 36 is arranged on the side of the disk 35 turned away from the front surface 13. The window blind casing 14, which is not shown in detail here, can be attached to this projection 36.

The circumferential surface 16 of the axis segment 15 has a groove 37 in the area of the cylindrical segment-shaped area. The groove 37 is arranged approximately in the center in relation to the height of the axis segment 15 starting from the front surface 13 in the direction of an end face 38 of axis segment 15. In this case, groove 37 runs, with regard to its longitudinal axis, in a circular segment-shaped manner along the cylindrical-segment-shaped area in the front view of the circumferential surface 16 of the axis segment 15. The course of the groove 37 and the alignment of the longitudinal axis of the groove 37 determine the direction of rotation of the mounting element 18 about the axis segment 15. Because of the groove 37, the locking block 30 is split into a first partial block 39 and a second partial block 40.

Figure 11:
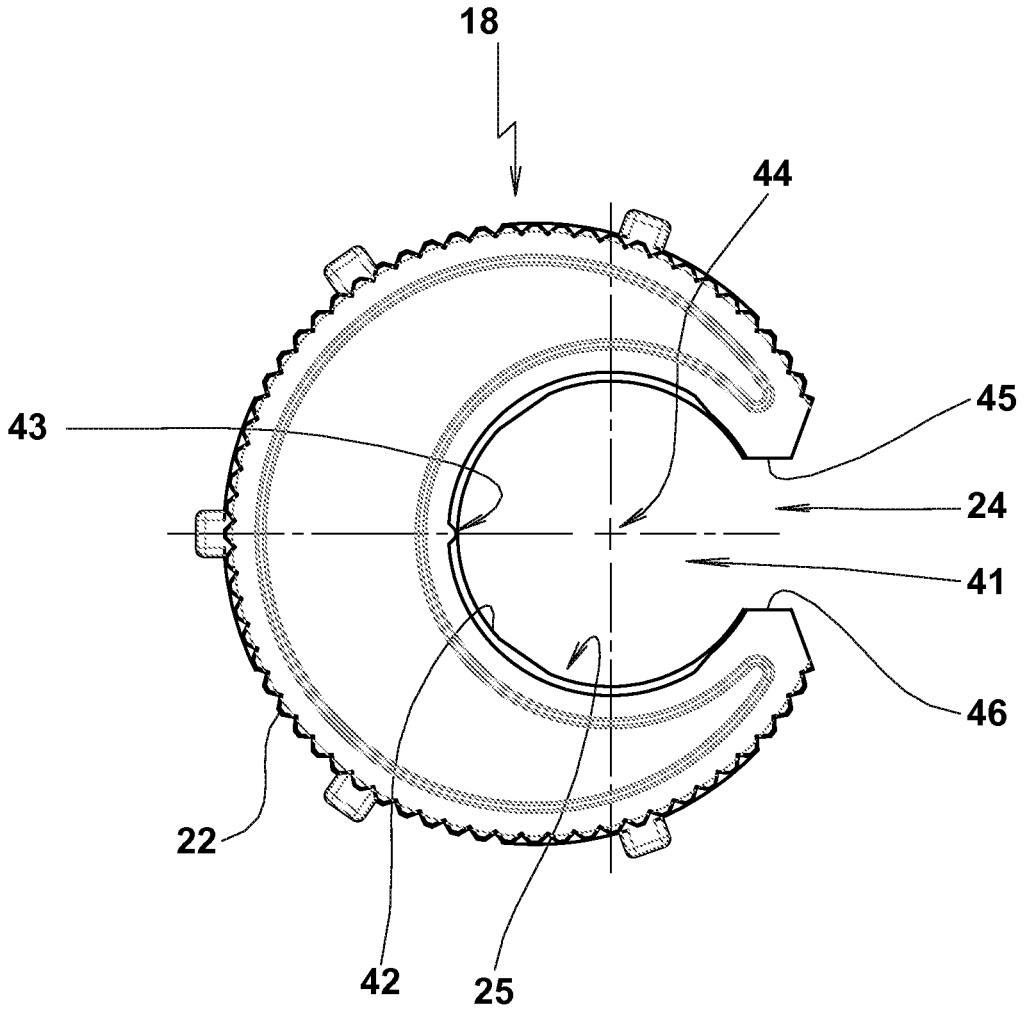
FIG. 11 is a top view of a mounting element for the device according to the present invention.

FIG. 11 shows a top view of a mounting element 18 for the device 10 according to the present invention. The mounting element 18 has an essentially C-shaped basic shape with the opening 24 in the outer circumference 22. Mounting element 18 forms an essentially cylindrical axial mounting 41 with a virtual axis of rotation 44 here. In the state mounted on the axis segment 15, the axis segment 15 is accommodated in the axial mounting 41, whereby the mounting element 18 can be rotated about the axis of rotation 44 produced by the axis segment 15.

The mounting element 18 has an inner side 25 in the area of the axial mounting 41. The inner side 25 has a bar 42. The bar 42 runs, with regard to its longitudinal axis, in a circular segment-shaped manner along the entire length of the inner side 25, which has a cylindrical segment shape in the top view. The bar 42 is also designed, such that in the state of the mounting element 18 mounted on the axis segment 15, this bar 42 meshes with the groove 37 to form an axial guide.

Furthermore, the inner side 25 has a first locking element designed as a locking bar 43. The locking bar 43 is aligned at right angles to the longitudinal direction of the bar 42 and is arranged in the center facing the opening 24. The height or thickness of the locking bar 43 corresponds to the height or thickness of the bar 42 in this exemplary embodiment. The height of the locking bar 43 and/or the height of the bar 42 determine the locking force.

In the area of the opening 24 the mounting element 18 also has a second locking element and a third locking element, whereby these are designed as two front faces 45, 46. Front faces 45, 46 determine the size of the opening 24 or define the opening 24, whereby the front faces 45, 46 face each other on the front side.

Figure 12:
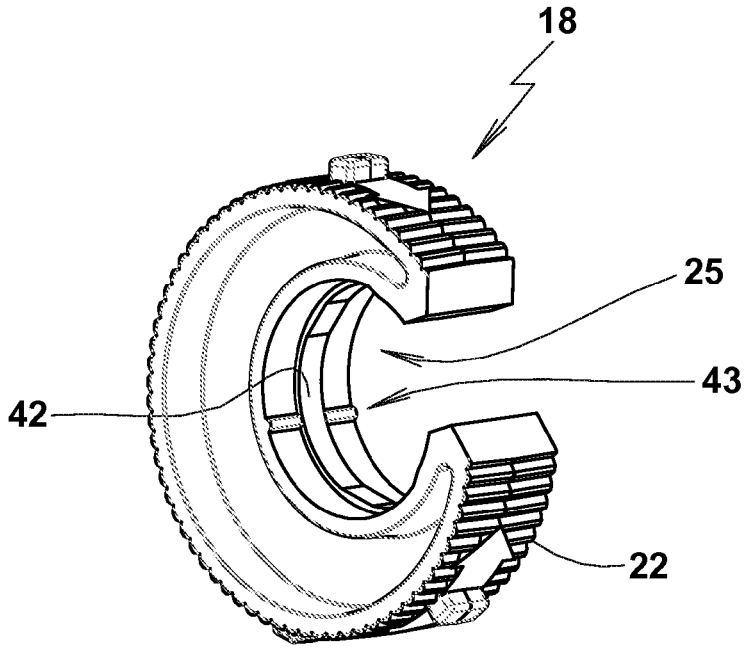
FIG. 12 is a first perspective view of the mounting element according to FIG. 11.

FIG. 12 shows a first perspective view of the mounting element 18 according to FIG. 11. The mounting element 18 has a grooved structure on the outer circumference in order to increase the grippability for a rotation of the mounting element 18. In addition, the above-described position and alignment of the bar 42 and of the locking bar 43 on the inner side 25 can be seen.

Figure 13:
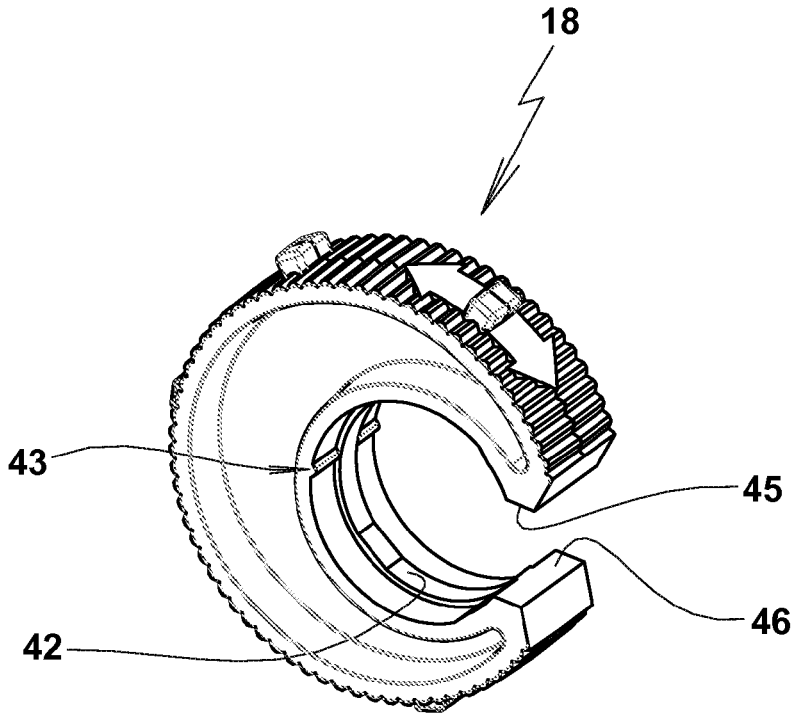
FIG. 13 is a second perspective view of the mounting element according to FIG. 11.

FIG. 13 shows a second perspective view of the mounting element 18 according to FIG. 11.

Figure 14:
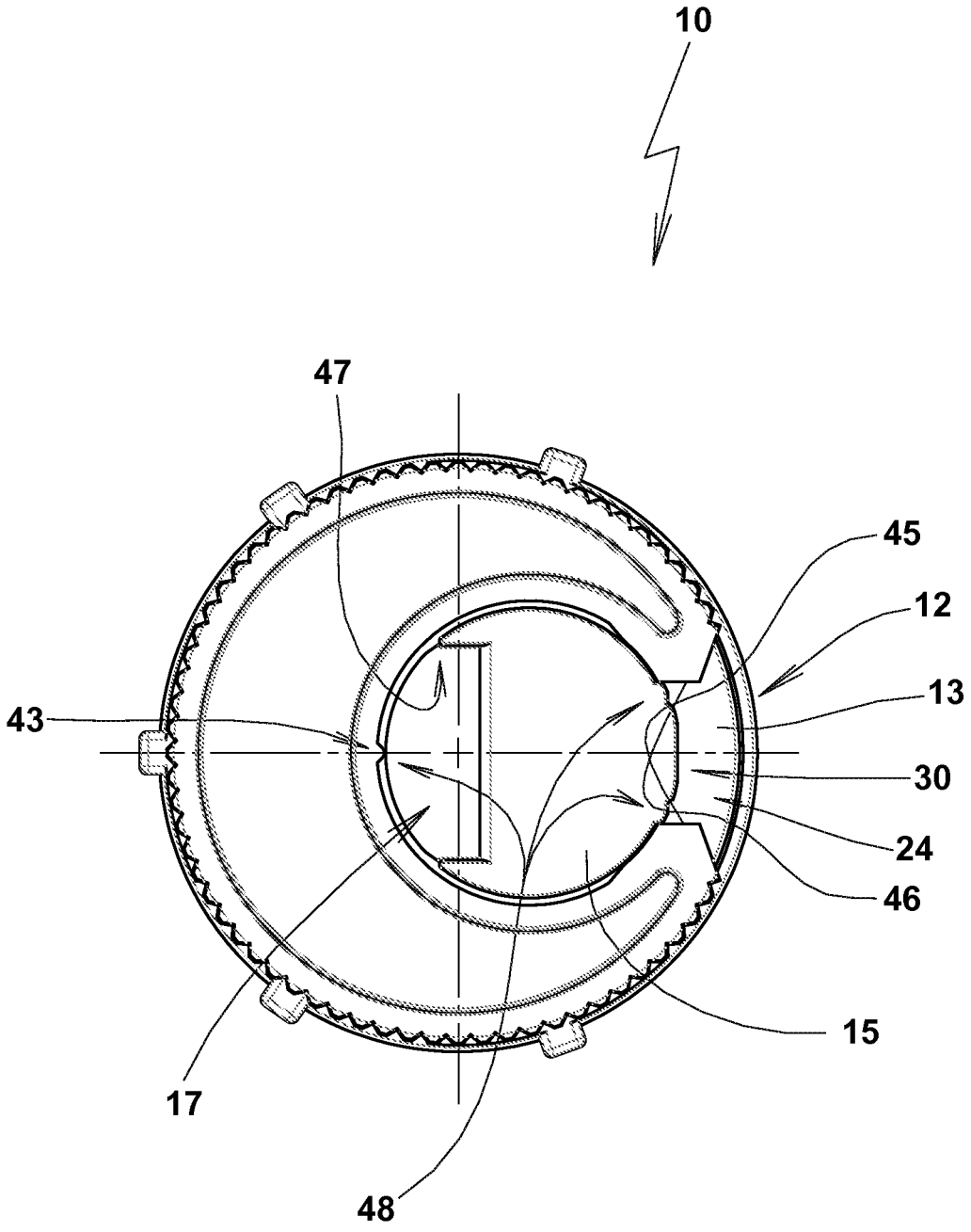
FIG. 14 is a front view of the device according to the present invention with a window blind end piece according to FIG. 9 and a mounting element according to FIG. 11.

Finally, FIG. 14 shows a front view of the device 10 according to the present invention with a window blind end piece 12 according to FIG. 9 and a mounting element 18 according to FIG. 11. In the exemplary embodiment shown here, the mounting element 18 is located in the second rotation position.

The bar 42 of the mounting element 18 forms an axial guide 47 together with the groove 37 of the axis segment. Because of the axial guide 47, on the one hand, the position of the mounting element 18 is fixed in relation to the central axis 26 or axis of rotation 44. On the other hand, the axial guide 47, because of its design as a circular slideway guide, makes possible a rotation of the mounting element 18 about the axis of rotation 44 or the axis segment 15.

The locking block 30 of the axis segment 15 forms a positioning means 48 together with the front faces 45, 46 and the locking bar 43. By means of the positioning means 48, the mounting element 18 can be detachably fixed in a first, second or third rotation position in relation to the rotatability of the mounting element 18 about the axis segment 15.

The mode of operation of the present invention is explained in detail below on the basis of FIGS. 1 through 14:

For fastening a window blind end piece 12 to a fastening element 11, the mounting element 18 is rotated into the first rotation position or the second rotation position depending on the desired left-sided or right-sided mounting. For this, it is possible, with an expenditure of force which can be applied manually and without tools, to push the front face 45 or 46 and the locking bar 43 over the stop face 31 or 32 and the locking grooves 33, 34, as a result of which a rotation of the mounting element 18 via the locking block 30 is made possible.

For a right-sided mounting, the mounting element 18 is rotated, such that the locking bar 43 meshes with the locking groove 34. Consequently, the front face 46 terminates flush with the side wall 29. Consequently, the opening 24 corresponds to holding mount 17. This makes possible an insertion of the holding segment 19 of the fastening element 11 into the holding mount 17. In this case, the free end of the mounting element 18 with the front face 45 extends a bit into the area of holding mount 17. Consequently, insertion of the holding segment 19 and correct positioning in the holding mount 17 are facilitated.

Subsequently, the mounting element 18 is rotated clockwise, whereby the locking bar 43 no longer meshes with the locking groove 34. The mounting element 18 is rotated until the second rotation position is reached. In the second rotation position, the front face 45 is in contact with the stop face 31 and the front face 46 is in contact with the stop face 32. Consequently, the mounting element 18 is stopped in the second rotation position.

To detach the window blind end piece 12 from the fastening element 11, the described process takes place in the reverse sequence. The mounting element is rotated about the axis of rotation 44 into the first rotation position counterclockwise from the second rotation position with an expenditure of force that can be applied manually and without tools.

For a left-sided mounting, the mounting element 18 is rotated, such that the locking bar 43 meshes with the locking groove 33. Consequently, the front face 45 terminates flush with the side wall. The opening 24 consequently corresponds to the holding mount 17. This makes possible an insertion of the holding segment 19 of the fastening element 11 into the holding mount 17. In this case, the free end of the mounting element 18 with the front face 46 extends a bit into the area of holding mount 17, as a result of which achieving the correct positioning in the holding mount 17 is facilitated.

Subsequently, the mounting element 18 is rotated counterclockwise, whereby the locking bar 43 no longer meshes with the locking groove 33. The mounting element 18 is rotated until the second rotation position is reached. To detach the window blind end piece 12 from the fastening element 11, the described process takes place in the reverse sequence. The mounting element 18 is rotated about the axis of rotation 44 clockwise from the second rotation position into the first rotation position with an expenditure of force that can be applied manually and without tools.

Thus, the device 10 according to the present invention with a mounting element 18 mounted once on the axis segment 15 makes possible, with a simple rotatability of the mounting element 18, a selective left-sided or right-sided mounting at a fastening element 11 without the mounting element 18 proper having to be removed from the axis segment 15 for a change from a left-sided to a right-sided mounting or vice versa. Moreover, because of the function separation of the axial guide 47 from the positioning means 48, a lower wear and a higher stability are achieved.

While specific embodiments of the invention have been shown and described in detail to illustrate the application of the principles of the invention, it will be understood that the invention may be embodied otherwise without departing from such principles.

APPENDIX:

| List of Reference Numbers: | |
|---|---|
| 10 | Device |
| 11 | Fastening element |
| 12 | Window blind end piece |
| 13 | Front surface |
| 14 | Window blind housing |
| 15 | Axis segment |
| 16 | Circumferential surface |
| 17 | Holding mount |
| 18 | Mounting element |
| 19 | Holding segment |
| 20 | First leg |
| 21 | Second leg |
| 22 | Outer circumference |
| 23 | Outer circumference |
| 24 | Opening |
| 25 | Inner side |
| 26 | Central axis |
| 27 | Mount base |
| 28 | Side wall |
| 29 | Side wall |
| 30 | Locking block |
| 31 | Stop surface |
| 32 | Stop surface |
| 33 | Locking groove |
| 34 | Locking groove |
| 35 | Pane |
| 36 | Projection |
| 37 | Groove |
| 38 | End face |
| 39 | Partial block |
| 40 | Partial block |
| 41 | Axial mounting |
| 42 | Bar |
| 43 | Locking bar |
| 44 | Axis of rotation |
| 45 | Front surface |
| 46 | Front surface |
| 47 | Axial guide |
| 48 | Positioning means |

What is claimed is:

1. A device for fastening a window blind with a window blind end piece comprising:

a front surface;

a mounting element;

an axis segment arranged on the front surface, the axis segment interacting with the mounting element, which can be rotated about an axis of rotation of the axis segment, for at least one of opening and closing a holding mount;

an axial guide fixing an axial position of the mounting element in relation to the axis of rotation of the mounting element about the axis segment; and a positioning means, which is separate from the axial guide, for detachable fixing of the mounting element in at least one rotation position of the mounting element in relation to the axis segment, the positioning means comprising a locking block arranged on a circumferential surface of the axis segment, wherein at least one of the locking block comprises a raised section extending in an outwards direction in relation to the circumferential surface of the axis segment and the locking block is arranged on a side of the axis segment turned away from the holding mount.

2. A device in accordance with claim 1, wherein:

the axial guide comprises a slideway guide, which comprises a groove and a bar meshing with the groove;

the axis segment defines the groove and the groove runs concentrically to the axis of rotation of the axis segment in a circumferential surface, which has a cylindrical segment shape; and the mounting element defines the bar on an inner side, the bar having a cross section with a circular segment shape.

3. A device in accordance with claim 1, wherein the circumferential surface has a cylindrical segment shape.

4. A device in accordance with claim 3, wherein the locking block has two stop faces arranged turned away from one another, whereby the stop faces are aligned parallel to a central axis of the window blind end piece with regard to a longitudinal alignment, and/or an opening angle of greater than 90° arises between the circumferential surface and the stop faces.

5. A device in accordance with claim 3, wherein the locking block has two locking grooves that are in a longitudinal alignment, parallel to a central axis of the window blind end piece.

6. A device in accordance with claim 1, wherein the positioning means has a first locking element, which is arranged on an inner side, which has a cylindrical segment shape, of the mounting element, whereby the first locking element comprises a locking bar.

7. A device in accordance with claim 6, wherein the locking bar is in a longitudinal alignment to a central axis of the window blind end piece.

8. A device in accordance with claim 3, wherein: the locking bar interacts with one of the stop faces and/or the locking grooves of the locking block for detachably fixing said mounting element in at least one rotation position.

9. A device in accordance with claim 1, wherein the mounting element has an axial mounting region for mounting the axis segment, whereby the axial mounting region and the mounting element have a circumferential opening, the mounting element having a C-shaped basic shape in cross section defining the circumferential opening, whereby a locking bar is arranged facing the circumferential opening of the C-shaped mounting element.

10. A device in accordance with claim 6, wherein the positioning means has at least one of a second locking element and a second locking element and a third locking element, whereby the second locking element or the second locking element and the third locking element are designed as a front face of the mounting element.

11. A device in accordance with claim 10, wherein the front face of the mounting element or front faces of the mounting element face inwardly or face one another adjacent to the circumferential opening of the axial mounting region or the mounting element, whereby the front face or front faces is in longitudinal alignment to a central axis of the window blind end piece.

12. A device in accordance with claim 3, wherein:

the positioning means has a first locking element, a second locking and a third locking element;

the locking block has a material thickness, which makes possible a jumping of the first, second and/or third locking element over the locking block with a sufficient expenditure of force in a direction of rotation of the mounting element about the axis segment, whereby a jumping over of the locking block with the first, second and/or third locking element based on a manual actuation can preferably be achieved.

13. A process for using a device for fastening a window blind and/or window blind end piece, the process comprising the steps of:

providing a fastening device comprising a front surface, a mounting element, an axis segment arranged on the front surface, the axis segment interacting with the mounting element, which can be rotated about an axis of rotation of the axis segment, for opening and/or closing a holding mount, an axial guide fixing an axial position of the mounting element in relation to the axis of rotation of the mounting element about the axis segment and a positioning means, which is separate from the axial guide, for detachable fixing of the mounting element in at least one rotation position of the mounting element in relation to the axis segment said positioning means comprising a locking block arranged on a circumferential surface of the axis segment, wherein at least one of the locking block comprises a raised section extending in an outwards direction in relation to the circumferential surface of the axis segment and the locking block is arranged on a side of the axis segment turned away from the holding mount;

selectively employing the mounting element, fastened to the axis segment by means of the axial guide, for a right-sided or left-sided mounting for mounting a holding segment in the holding mount, based on a rotation of the mounting element about the axis segment.

14. A window blind end piece fastening device comprising:

a front surface;

a mounting element;

an axis segment arranged on said front surface, said axis segment having an outer circumferential surface defining a rotation surface in contact with an inner surface of said mounting element for rotation of said mounting element about an axis of rotation of said axis segment, and outer circumferential surface at least partially defining a holding mount;

an axial guide fixing an axial position of said mounting element in relation to said axis of rotation of said mounting element about said axis segment; and a positioning structure separate from said axial guide, for detachable fixing of said mounting element in at least one rotation position of said mounting element in relation to said axis segment, said positioning means comprising an outer surface locking contour defined by said outer circumferential surface, wherein at least one of said outer surface locking contour comprises a raised section extending in an outwards direction in relation to an adjacent portion of said outer circumferential surface and said locking contour is arranged on a side of said axis segment turned away from said holding mount.

15. A device in accordance with claim 14, wherein:

said axial guide is defined by interacting portions of each of said mounting element and said axis segment.

16. A device in accordance with claim 15, wherein:

said interacting portions including a groove and a bar meshing with the groove;

said axis segment defines said groove and said groove runs concentrically to said axis of rotation of said axis segment defined by said outer circumferential surface, which has a cylindrical segment shape; and said mounting element defines said bar on said inner surface, said bar having a cross section with a circular segment shape.

17. A device in accordance with claim 14, wherein said positioning means further comprises a locking element defined by said inner surface of said mounting element and comprising an inner surface locking contour interacting with said outer surface locking contour for detachably holding said mounting element in at least one rotation position relative to said axial guide.

18. A device in accordance with claim 14, wherein said mounting element has a C-shaped basic shape in cross section defining a circumferential opening.

19. A device in accordance with claim 18, wherein:

said axis segment arranged eccentrically with respect to a center of said front surface;

said front surface has right mounting indicia and left mounting indicia, each respectively spaced from the center of said front surface;

said positioning means has a plurality of holding positions for holding a rotational position of said mounting element relative to said access segment including a blocking position with said circumferential opening circumferentially spaced from said holding mount with said mounting element blocking access to said holding mount, a right mounting position with said circumferential opening providing access to said holding mount and said mounting element covering said left mounting indicia and a left mounting position with said circumferential opening providing access to said holding mount and said mounting element covering said right mounting indicia.

* * * * *